US009702132B2

(12) United States Patent
Chimene

(10) Patent No.: US 9,702,132 B2
(45) Date of Patent: Jul. 11, 2017

(54) TOILET NIGHT LIGHT

(71) Applicant: Kenneth Ray Chimene, Lake Worth, FL (US)

(72) Inventor: Kenneth Ray Chimene, Lake Worth, FL (US)

( * ) Notice: Subject to any disclaimer, the term of this patent is extended or adjusted under 35 U.S.C. 154(b) by 225 days.

(21) Appl. No.: 14/542,184

(22) Filed: Nov. 14, 2014

(65) Prior Publication Data

US 2016/0138254 A1 May 19, 2016

(51) Int. Cl.

| | |
|---|---|
| ***E03D 9/00*** | (2006.01) |
| ***F21V 33/00*** | (2006.01) |
| *A47K 17/00* | (2006.01) |
| *E03D 9/03* | (2006.01) |
| *F21V 21/088* | (2006.01) |
| *F21S 9/02* | (2006.01) |
| *F21V 23/04* | (2006.01) |
| *F21Y 101/00* | (2016.01) |

(52) U.S. Cl.

CPC ..... *E03D 9/00* (2013.01); *F21V 33/004* (2013.01); *A47K 17/00* (2013.01); *E03D 9/007* (2013.01); *E03D 9/032* (2013.01); *F21S 9/02* (2013.01); *F21V 21/088* (2013.01); *F21V 23/0471* (2013.01); *F21Y 2101/00* (2013.01)

(58) Field of Classification Search

CPC .. F21V 33/004; F21V 23/0471; F21V 21/088; F21S 9/02; E03D 9/00; E03D 9/007; E03D 9/032; A47K 13/24; A47K 13/30; A47K 17/00

See application file for complete search history.

(56) References Cited

U.S. PATENT DOCUMENTS

| | | | | | |
|---|---|---|---|---|---|
| 5,003,648 | A * | 4/1991 | Anderson | A47K 13/30 | 4/314 |
| 5,136,476 | A * | 8/1992 | Horn | A47K 17/00 | 362/198 |
| 5,150,962 | A * | 9/1992 | Rauschenberger | A47K 17/00 | 362/101 |
| 5,263,209 | A * | 11/1993 | Pattee | A47K 13/24 | 362/101 |
| 5,926,867 | A * | 7/1999 | Buchanan | A47K 13/24 | 353/43 |
| 9,041,298 | B2 * | 5/2015 | Andy | H05B 37/0227 | 315/133 |
| 9,345,110 | B2 * | 5/2016 | Miller | H05B 37/0227 | |
| 9,380,918 | B2 * | 7/2016 | Murphy | A47K 13/24 | |
| 2008/0028505 | A1 * | 2/2008 | Penn | E03D 9/007 | 4/231 |

* cited by examiner

*Primary Examiner* — J. Casimer Jacyna

(74) *Attorney, Agent, or Firm* — Dunlap Bennett & Ludwig PLLC

(57) ABSTRACT

A toilet night light is provided. The toilet night light includes a housing. A clip is attached to the housing and is sized to releasably attach to a toilet bowl suspending the toilet night light under the toilet seat. A light is disposed within the housing. The light is directed to at least an inside portion of the toilet bowl to illuminate the inside of the toilet bowl. A power source, such as a battery is electrically connected to power the light. The present invention further include a switch operatively connected to the light and is activated to turn the light on and off.

6 Claims, 5 Drawing Sheets

TOILET NIGHT LIGHT

BACKGROUND OF THE INVENTION

The present invention relates to a night light and, more particularly, to a night light attachable to the toilet to illuminate at least the inside of the toilet.

When using the bathroom at night, a person may have to manually turn on the main bathroom light at night. The main bathroom light disrupts the circadian rhythm, making it difficult for the user to go back to sleep. Further, keeping the light off in the bathroom increases the chances of missing the toilet while urinating and making a mess.

As can be seen, there is a need for a device that illuminates the toilet without disrupting the circadian rhythm.

SUMMARY OF THE INVENTION

In one aspect of the present invention, a toilet night light comprises: a housing; a clip attached to the housing and sized to releasably attach to a toilet bowl; a light within the housing, and directed to at least an inside portion of the toilet bowl; a power source electrically connected to the light; and a switch operatively connected to the light, wherein the switch is activated to turn the light on and off.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a toilet and bathroom nightlight with a light bar clip that lights up the inside and outside of the toilet. The present invention may further include an attachment point for deodorizing/cleaning the toilet, as well as motion and light sensor. This battery-powered invention may include the following benefits: turns the bathroom nightlight on automatically when motion is detected; uses a Light Emitting Diode (LED) that does not dilate the pupils, making it easier to go back to sleep; lights up the inside of the toilet making it easy to see where to urinate; and may include an attachment point for a toilet deodorizer and/or cleaner, which cleans or deodorizes with each flush. In certain embodiments, the present invention also lights up the outside of the toilet area and bathroom making it easy to see the toilet paper roll.

The Intergraded Circuit board components may include: a motion sensor, light sensor, LED, wiring, resistors, capacitors, waterproof multi-position control [on-off-auto], battery leads, and battery. The housing may include an opening for the light sensor lens cover, the motion sensor lens cover, and the battery cover. The Intergraded Circuit board and it components may fit inside of the housing. The light reflector and LED lens cover may fit on top and in between the assembled front housing and the back housing with the LED pointing towards the back housing and light reflector where the acrylic/polycarbonate light bar/clip attaches with a plastic holding brace through the back housing cover and light reflector exposing the end of the light bar/clip directly in front of the LED.

The acrylic/polycarbonate light bar/clip is a molded light bar/clip in the shape of a right angle. The top end of the light bar/clip is inserted into the top part of the back housing and passes through the backside of the light reflector to a point where just the end of the light bar/clip is exposed to the LED. The other end of the light bar/clip is turned down to form a clip for the assembly product that fits over the toilet bowl. The down turned light bar/clip has an attachment point at the bottom inside end for an optional deodorizer/ cleaning product. The front and back housing and the lens cover may be sealed with a water proofing sealant.

Figure 1:
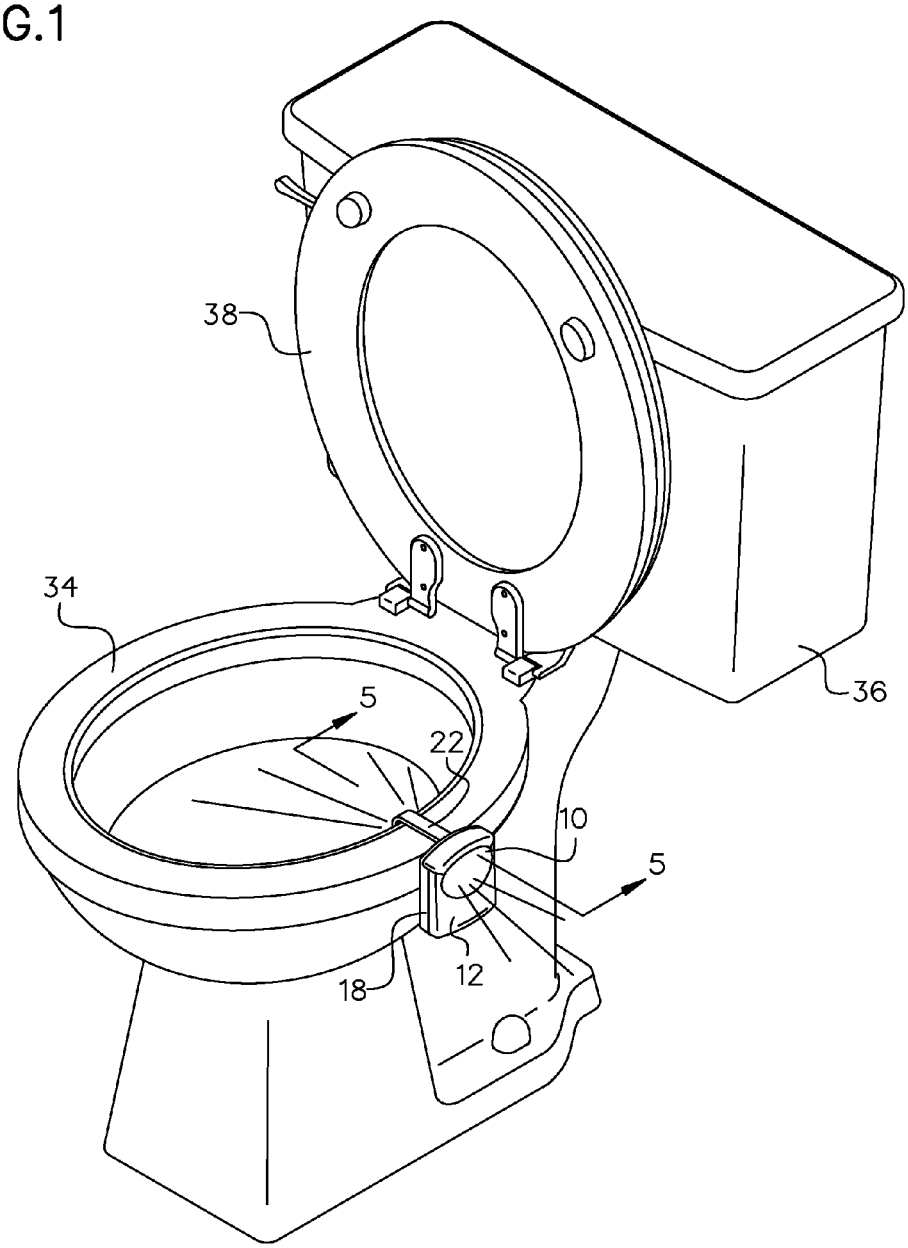
FIG. 1 is a perspective view of an embodiment of the present invention shown in use.
Figure 2:
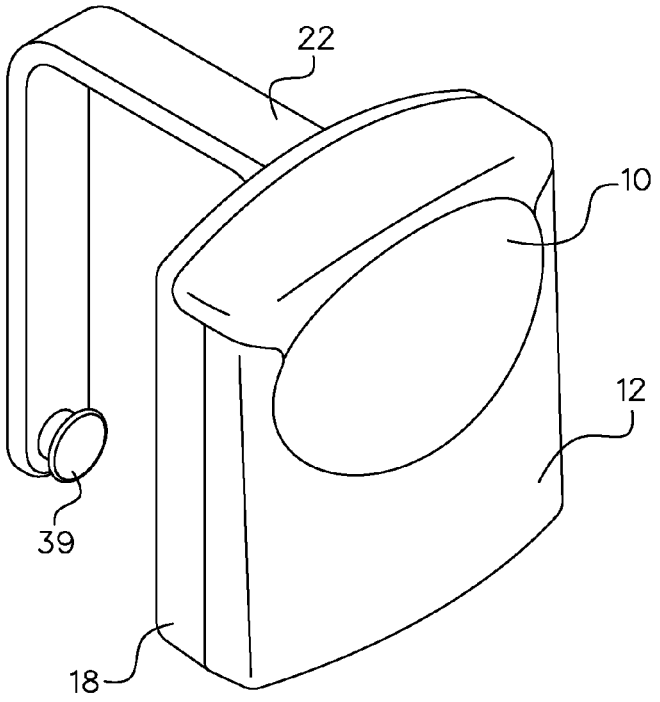
FIG. 2 is a front perspective view of an embodiment of the present invention.
Figure 3:
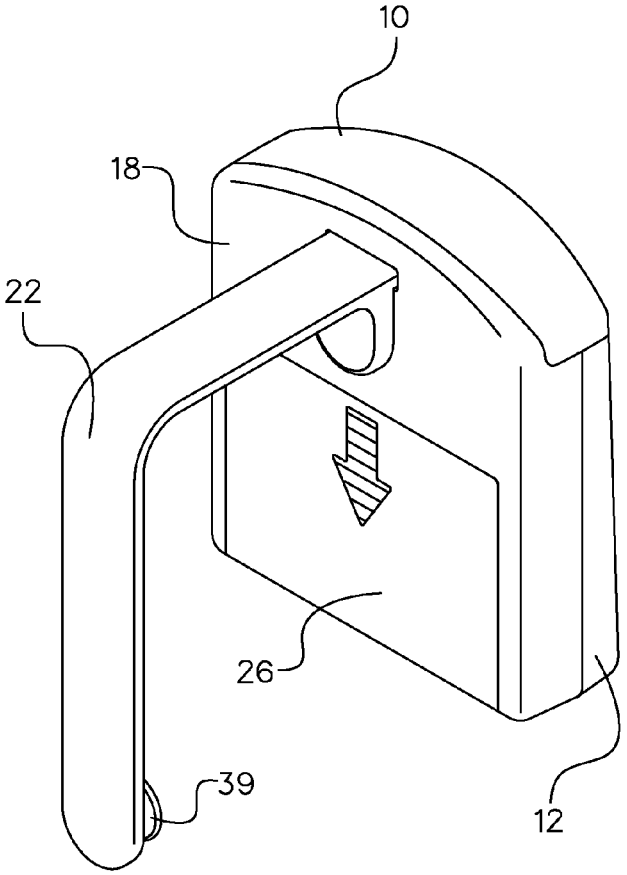
FIG. 3 is a back perspective view of an embodiment of the present invention.
Figure 4:
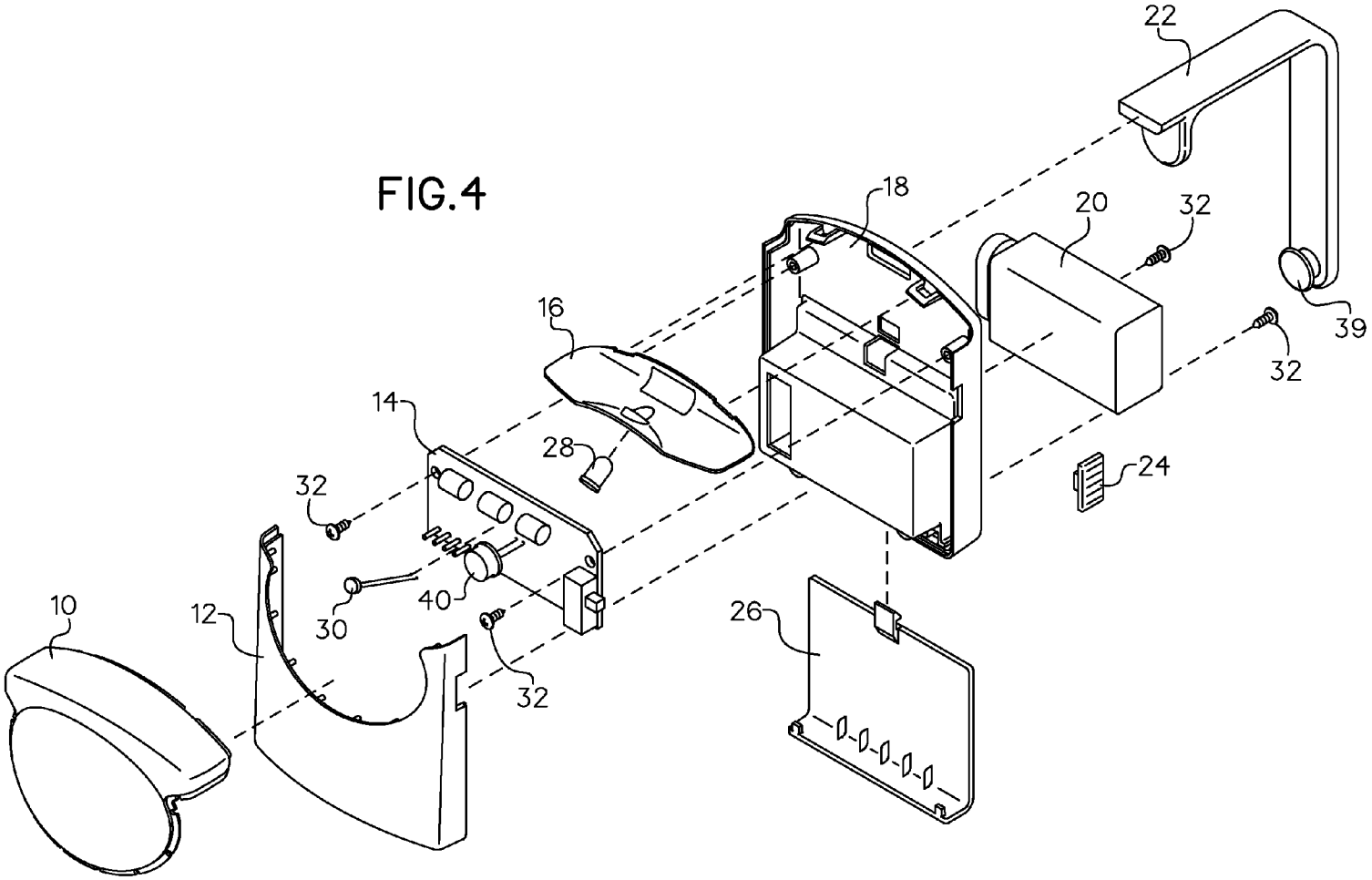
FIG. 4 is an exploded view of an embodiment of the present invention.
Figure 5:
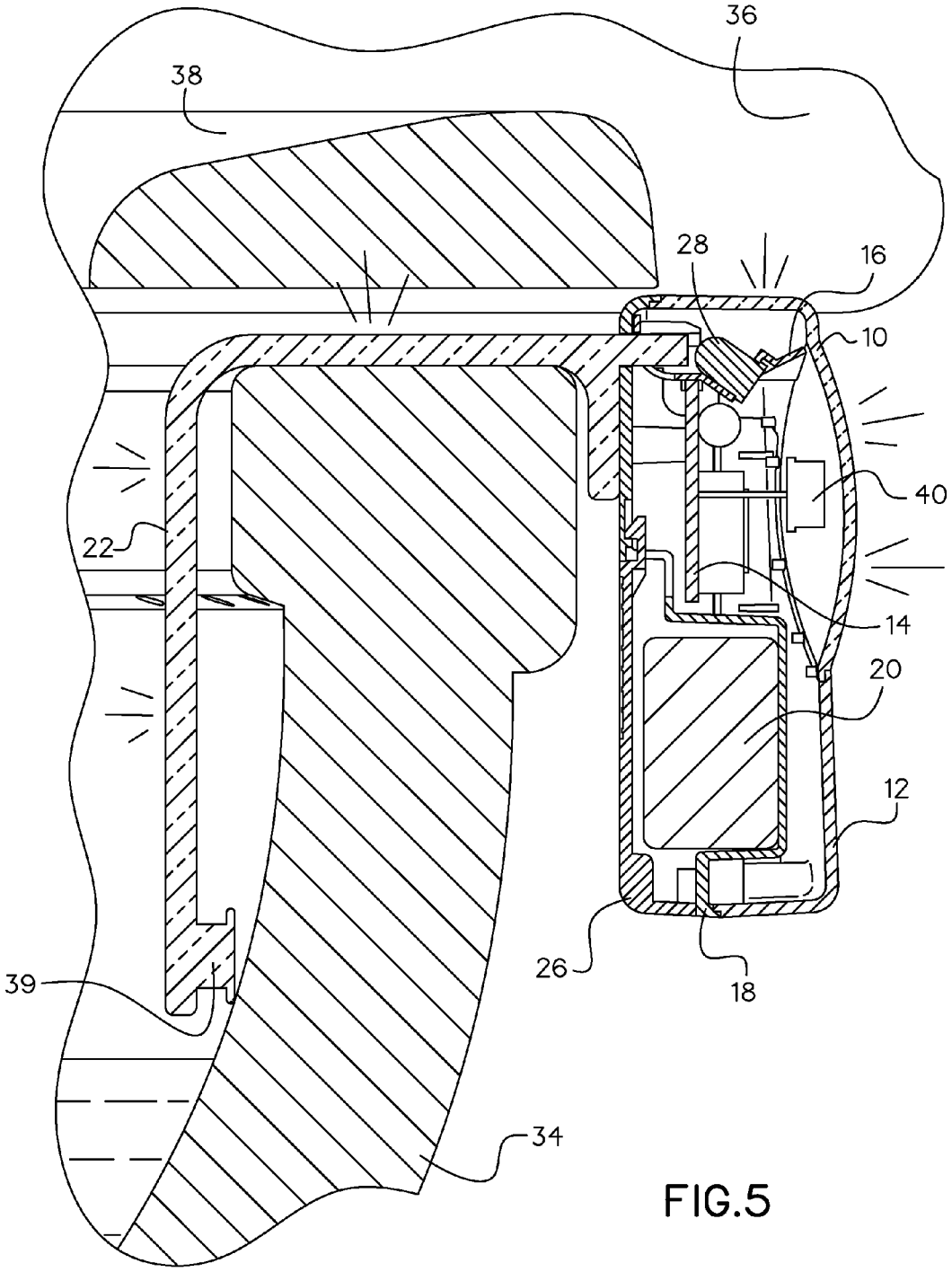
FIG. 5 is a section view taken along line 5-5 in FIG. 1.
Figure 6:
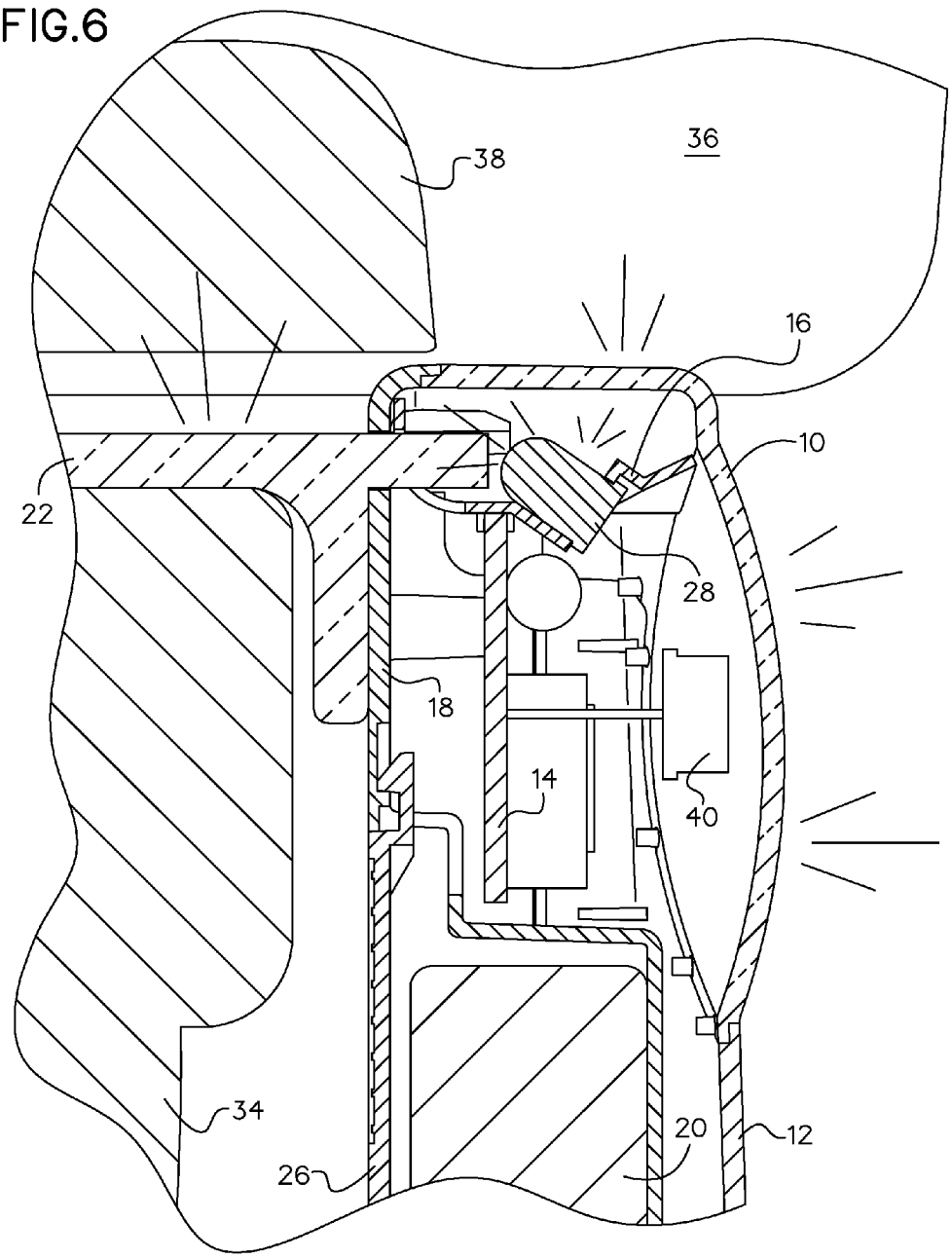
FIG. 6 is an enlarged detailed section view of an embodiment of the present invention.

Referring to FIGS. 1 through 6, the present invention includes a toilet night light. The toilet night light includes a housing 12, 18. A clip 22 is attached to the housing 12, 18 and is sized to releasably attach to a toilet bowl 34 suspending the toilet night light under the toilet seat 38. A light 28 is disposed within the housing 12, 18. The light 28 is directed to at least an inside portion of the toilet bowl 34 to illuminate the inside of the toilet bowl 34. A power source, such as a battery 20 is electrically connected to power the light 28. The present invention further include a switch operatively connected to the light 28 and is activated to turn the light 28 on and off.

The housing 12, 18 of the present invention may house the electrical components within. In certain embodiments, the housing 12, 18 includes a front side 12 and a back side 18. The front side 12 faces away from the toilet bowl 34 when the clip 22 is attached to the toilet bowl 34. The front side 12 and the back side 18 may be releasably securable to one another forming an internal portion in between. In certain embodiments, the present invention may include a cover 10. The cover 10 may be transparent allowing light to enter and leave the housing 12, 18. In certain embodiments, a substantial portion of the cover 10 is disposed on the front side 12, allowing light to travel into the housing 12, 18 through the front side 12.

The present invention may further include a circuit board 14 within the housing 12, 18. The circuit board 14 may electrically connect the switch, the power source 20 and the light 28. The present invention may further include a motion sensor 40 attached to the circuit board 14. The motion sensor 40 faces towards the transparent cover 10. The motion sensor 40 is operable to detect a motion and activate the switch, thereby activating the light 28. In certain embodiments, the light may remain on for a set period of time, such as thirty seconds, after the motion sensor 44 has detected a motion.

In certain embodiments, the light 28 may be an LED. In such embodiments, the clip 22 may be a light bar. The LED may be facing the light bar and may thereby illuminate the light bar, as illustrated in the Figures. In certain embodiments, light may be directed towards the inside of the toilet bowl 34 and the outside of the toilet bowl 34. In such embodiments, the present invention may include a reflector 16 positioned inside the housing 12, 18 to receive a portion of the light from the LED and reflect the portion of the light towards the transparent cover 10 and out of the housing 12, 18.

In certain embodiments, the present invention may further include a light sensor 30. The light sensor 30 may be attached to the circuit board 14 and may face towards the transparent cover. The light sensor 30 may be used to conserve battery by preventing the light 28 to turn on during inappropriate times. For example, during the day the light sensor 30 may sense the sunlight and prevent the motion sensor 40 from activating the light 28. Further, if the bathroom light is on, the light sensor 30 may sense the light and prevent the motion sensor 40 from activating the light 28.

The present invention may further include an on, off and auto control 24 operatively connected to the switch. The on selection of the control 24 may turn the light 28 on, and the off selection of the control 24 may turn the light 28 off regardless of the detection of the motion 40 and light sensors 30. The auto selection of the control 24 may turn on and off the light 28 based on the motion sensor 40 and the light sensor 30, as described above.

The clip 22 of the present invention may also include an attachment point 39 at the end. The attachment point 39 may be suspended within the toilet bowl 34 when the toilet night light is attached to the toilet 36. Either a deodorizer or a cleaner may be attached to the attachment point 39. Therefore, the present invention may be used while deodorizing and cleaning the toilet 36.

In certain embodiments, the circuit board 14 may be secured to the back side 18 of the housing 12, 18 by screws 32. The front side 12 may snap onto the back side 18 and the transparent cover 10 may snap into the front side 12 and back side 12. The clip 22 may be secured within an aperture through the back side 18. The battery may be secured within a battery housing of the back side 18 and covered by a snap in cover 26.

It should be understood, of course, that the foregoing relates to exemplary embodiments of the invention and that modifications may be made without departing from the spirit and scope of the invention as set forth in the following claims.

What is claimed is:

1. A toilet night light comprising:

a housing comprising a front side comprising a transparent cover and a back side;

a clip attached to the housing and sized to releasably attach to a toilet bowl, wherein the clip comprises a light bar;

a light within the housing, and directed towards the light bar;

a power source electrically connected to the light;

a switch;

a circuit board; and a motion sensor facing the transparent cover, wherein the motion sensor, the switch, the power source and the light are electrically connected to the circuit board, the motion sensor is operable to detect a motion and activate the switch, thereby activating the light, and the light remains on for a set period of time after the motion sensor has detected the motion.

2. The toilet night light of claim 1, wherein the light is a Light Emitting Diode.

3. The toilet night light of claim 2, further comprising a reflector positioned to receive a portion of the light from the Light Emitting Diode and reflect the portion of the light towards the transparent cover.

4. The toilet night light of claim 1, further comprising a light sensor attached to the circuit board and facing the transparent cover, wherein the light sensor is operable to prevent the switch from activating when light is sensed.

5. The toilet night light of claim 1, further comprising an on, off and auto control operatively connected to the switch, wherein the on control turns the light on, the off control turns the light off, and the auto control utilizes the motion sensor.

6. The toilet night light of claim 1, wherein the clip further comprising an attachment point configured to secure at least one of a toilet deodorizer and cleaner.

* * * * *